US006796341B2

(12) United States Patent
Durand

(10) Patent No.: US 6,796,341 B2
(45) Date of Patent: Sep. 28, 2004

(54) FILLING SPOUT FOR AN UMBRELLA-SHAPED JET

(75) Inventor: Cyrille Durand, Octeville-sur-Mer (FR)

(73) Assignee: Sidel, Octeville-sur-Mer (FR)

( * ) Notice: Subject to any disclaimer, the term of this patent is extended or adjusted under 35 U.S.C. 154(b) by 0 days.

(21) Appl. No.: 10/471,340

(22) PCT Filed: Mar. 12, 2002

(86) PCT No.: PCT/FR02/00872

§ 371 (c)(1),
(2), (4) Date: Sep. 10, 2003

(87) PCT Pub. No.: WO02/072467

PCT Pub. Date: Sep. 19, 2002

(65) Prior Publication Data

US 2004/0118480 A1 Jun. 24, 2004

(30) Foreign Application Priority Data

Mar. 13, 2001 (FR) ..... 01 03396

(51) Int. Cl.[7] ..... B65B 31/00
(52) U.S. Cl. ..... 141/70; 141/286
(58) Field of Search ..... 141/69, 70, 117, 141/236, 244, 285, 286, 295

(56) References Cited

U.S. PATENT DOCUMENTS 2,413,916 A 1/1947 Hallead
3,460,590 A * 8/1969 Robbins ..... 141/7
3,626,996 A 12/1971 Bingham
3,807,463 A 4/1974 Rademacher et al.
6,698,473 B2 * 3/2004 Decarne ..... 141/286

FOREIGN PATENT DOCUMENTS

DE 298 12 724 U 8/1999

* cited by examiner

*Primary Examiner*—Gregory L. Huson
*Assistant Examiner*—Peter deVore
(74) *Attorney, Agent, or Firm*—Sughrue Mion, PLLC

(57) ABSTRACT

A filling spout for distributing a liquid in a receptacle, delivering an umbrella-shaped jet, the distribution passage for the liquid being defined by two parallel truncated partition walls, one outer wall belonging to the body of the spout and the other inner wall belonging to a central core. The central core is conical, widens towards the outlet and is disposed coaxially in a cylindrical conduit of the body of spout, terminating in the truncated outer wall. A supporting foot for the central core is placed in between the central core and the wall of the cylindrical conduit, the foot being used to support the conical core in a coaxial manner in relation to the cylindrical conduit and extending from the tip of the core towards the outlet, taking the form of a diheydron wherein the edge coincides with the axis of the core.

6 Claims, 2 Drawing Sheets

FILLING SPOUT FOR AN UMBRELLA-SHAPED JET

FIELD OF THE INVENTION

The invention relates to improvements made to filling spouts for distributing a liquid to a container, of the type in which the spout has a liquid-distribution passage of annular cross section or quasi-annular cross section which generates an umbrella-shaped liquid jet at the outlet orifice, said passage being defined by two roughly parallel and roughly frustoconical facing walls, one of them, the outer one, belonging to a spout body and the other, the inner one, belonging to a central core of conical shape widening toward the aforesaid orifice and supported, by support means inserted between said core and the spout body, roughly coaxially in a roughly cylindrical duct defined in the spout body and ending at the aforesaid outer frustoconical wall.

DESCRIPTION OF THE PRIOR ART

The production of filling spouts designed to form a conical "umbrella-shaped" jet of liquid is known. Used to fill bottles, they in particular allow the liquid to be sprayed, very soon after it leaves the spout, against the inner wall of the bottle. The liquid is therefore introduced into the bottle by running along the wall, rather than in the form of a central jet sprayed directly toward the bottom of the bottle. In this way, the bottle can be filled with the minimum formation of foam or froth, making it possible to increase the filling rate and therefore reduce the time taken to fill the bottle.

However, known filling spouts for producing umbrella-shaped jet have disadvantages specific to the way in which the central core is supported.

In certain spouts, the central core is fixed behind the distribution orifice. If the fixing is too far upstream, the lower part of the central core that defines the distribution orifice lacks stability, and this has a detrimental influence on the continuity and homogeneity of the liquid curtain. If the fixing is situated only a short way upstream of the orifice, the liquid can no longer be conveyed axially and has therefore to be conveyed radially into the duct, and this disrupts the homogeneity of the flow at the orifice and, once again, has a detrimental impact on the continuity of the liquid curtain.

In other spouts, the central core is fixed by radial arms. Apart from the fact that these arms disrupt the liquid flow and constitute an appreciable local reduction in the cross section available for this flow, the arms may catch solid particles likely to be present in the liquid (fruit juice with bits for example) and this ultimately leads to an obstruction requiring the filling plant to be shut down for cleaning purposes.

SUMMARY OF THE INVENTION

There is therefore, on the part of the users, a pressing need for a filling spout with an umbrella-shaped jet that sets aside the disadvantages of the devices of the prior art.

To this end, a filling spout with an umbrella-shaped jet as mentioned in the preamble is characterized, being arranged in accordance with the invention, in that said support means comprise a leg which is inserted between said conical core and at least the wall of the cylindrical duct and which runs at least from the tip of the conical central core toward the orifice, in that the leg is in the shape of a dihedron resting on the wall of the duct and comprising a knife edge coinciding with the axis of the conical central core, and in that the upstream transverse wall of the leg, which is approximately triangular in shape, is inclined, upward, from the upstream to the downstream direction.

Advantageously, this leg may run as far as the lower end of the conical core and the distribution orifice is in the shape of a bean.

However, it is possible, by way of a variant, to provide that the leg does not run as far as the lower end of the conical core and that the distribution orifice is shaped as a full annulus; in this case, the continuity of the liquid curtain may be re-established at the orifice in spite of the presence of the leg situated significantly upstream and the liquid then flows in the form of a closed annular curtain.

Still according to a preferred embodiment, the leg is in the form of a dihedron resting via its widened part against the wall of the duct and comprising a knife edge coinciding with the axis of the conical central core; in addition, the upstream transverse wall of the leg, which is approximately triangular in shape, is inclined, from the bottom upward, from upstream to downstream. According to one exemplary embodiment able to ease the flow of the liquid stream, provision is made for the leg to start upstream of the tip of the conical core and for the knife edge of the dihedron formed by the leg, between its origin and the tip of the conical core, to be inclined and situated roughly in the continuation of the upper generatrix of the conical core.

In practice, suitable for the most commonplace applications, the manufacture of the spout is simplified if the central core is roughly conical of revolution, if the canal is roughly cylindrical of revolution and if the distribution orifice forms a bean shape running roughly in an arc of a circle.

In a specific exemplary embodiment that seems to be suited to most use scenarios, the distribution orifice extends over about 270° and the leg supporting the conical core forms a dihedron with a vertex angle of about 90°.

Also as a preference, the leg is connected to the conical central core and to the wall of the cylindrical duct by respective fillets so that no region remains that is able to slow or catch particles suspended in the liquid.

By virtue of the measures in accordance with the invention, a filling spout is formed that has the advantages specific to spouts that form an umbrella-shaped jet of liquid, but also has the characteristic of combining the advantages of an axial liquid lead-in, of presenting no transverse obstacle to the stream of liquid (the conical core is strictly speaking "suspended" in a coaxial central position) and finally of being shaped with no sharp corners and no dead corners, so that such a spout not only generates a liquid curtain in the form of an umbrella closed on itself or at the very least with a significant angular extent (for example over three quarters of a circle) but also lends itself particularly well to the processing of liquid containing relatively small-sized solid particles such as liquids (particularly fruit juices) containing pulp or bits.

BRIEF DESCRIPTION OF THE DRAWINGS

The invention will be better understood from reading the detailed description of certain embodiments given solely by way of nonlimiting example. In this description, reference is made to the attached drawings in which.

DETAILED DESCRIPTION OF THE INVENTION

In the description that follows, the device is considered in its vertical mounted position as shown in FIGS. 1, 2, 6 and 7; the terms "upper" and "lower" used hereinafter refer to this vertical mounted position, while the terms "upstream" and "downstream" are employed with reference to the direction in which the liquid flows, that is to say from top to bottom through the device.

Figure 1:
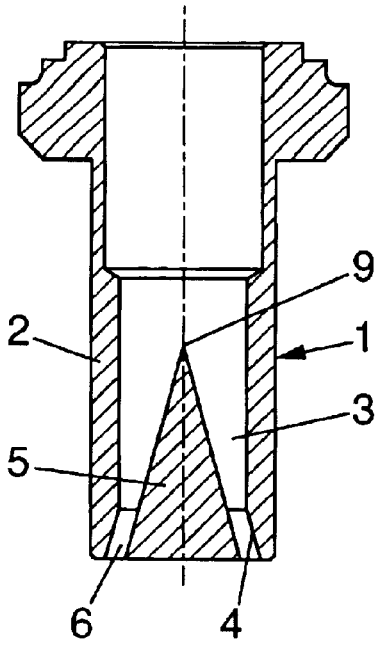
FIG. 1 is a side view in diametral section on I—I of FIG. 3 of a preferred embodiment of a filling spout arranged according to the invention.
Figure 2:
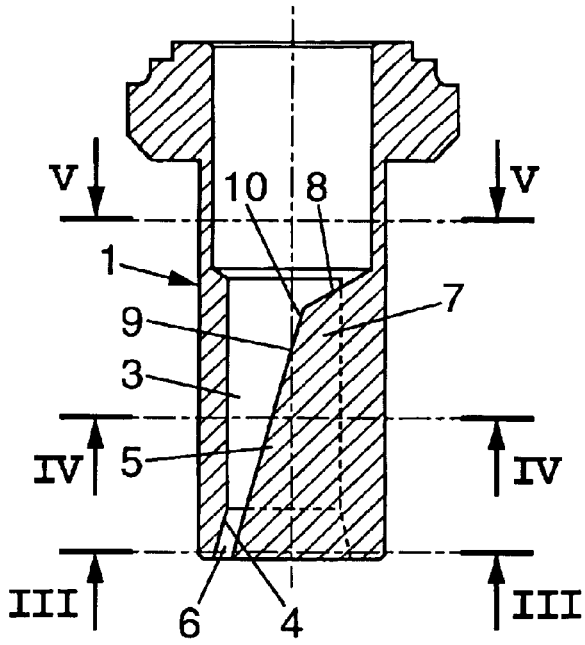
FIG. 2 is a side view in diametral section at right angles to the section of FIG. 1, on II—II of FIG. 3, of the spout of FIG. 1.

As illustrated in FIGS. 1 and 2, the filling spout denoted in its entirety by the numerical reference 1 comprises a body 2 through which there passes axially a duct 3 of roughly cylindrical overall shape; more specifically, in the example illustrated, which should be suited for most applications, the duct 3 is roughly cylindrical of revolution. Toward the lower end (at the bottom in FIGS. 1 and 2) of the spout, the duct 3 widens and is then defined by a frustoconical wall 4 (referred to later on as the outer frustoconical wall 4).

Arranged inside the duct 3 is a central core 5 of conical shape which, in the example depicted, has a shape that is conical of revolution. The core 5 is arranged coaxially with respect to the duct 3 and has a cone angle roughly the same as the aforesaid frustoconical wall 4 while having a transverse dimension smaller than that of the wall 4. In that way, the outer frustoconical wall 4 of the body and the inner conical wall of the conical core 5 define an annular or quasi-annular (bean-shaped) passage 6 which, in the example considered, is circular or in the shape of an arc of a circle.

The conical central core 5 has its tip 9 situated at the upstream end, that is to say facing toward the top of the body, inside the cylindrical duct 3 and runs as far as the lower end of the body 2; the base of the conical core is roughly coplanar with the lower annular edge of the body 2.

To support the conical core 5 in the central position, coaxial with respect to the duct 3, a support leg 7 is provided, inserted between the conical core 5 and the body 2 (FIG. 2). The leg 7 needs to be shaped to firmly support the conical core 5, in such a way as to prevent the latter from deforming and/or from vibrating and as to keep a stable geometric shape for the passage 6, while at the same time causing minimum disruption to the flow of liquid.

In the configuration illustrated in FIG. 2, the leg 7 runs from a region situated upstream of the tip 9 of the cone 5 toward the passage 6. In the example illustrated, the leg 7 runs along the entire length of the conical core 5, as far as its base, so that the orifice 6 is not in the shape of a closed annulus but in the shape of an open annulus or bean as visible in FIG. 3.

The leg 7 may be shaped into the shape of a dihedron having a base resting on the wall of the duct 3 and a knife edge 10 coinciding with the axis of the conical core 5 running in the continuation of the generatrix of said core as visible in FIG. 2. As a result, from rear to front, the dihedron-shaped leg gradually blends into the conical core, the shape of the dihedron being totally visible only upstream of the tip of the conical core (see FIG. 5) and having totally disappeared, merged into the conical shape of the core, at the lower part of the device (FIG. 3); between the two ends, the dihedron is visible only in part (FIG. 4).

At its upper end, the transverse face 8 of the dihedron is inclined, from the base toward the knife edge, from upstream to downstream, as visible in FIG. 2.

Figure 4:
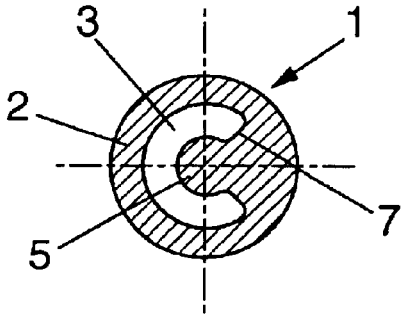
FIG. 4 is a view in cross section on IV—IV of FIG. 2 of the spout of FIGS. 1 to 3.
Figure 5:
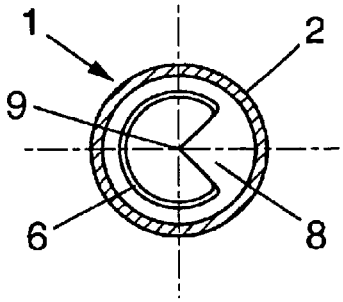
FIG. 5 is an end-on view, from the opposite end to that of FIG. 3, in section on V—V of FIG. 2.

Furthermore, as visible in FIG. 4, the leg 7 is connected, on the one hand, to the conical core 5 and, on the other hand, to the body 2 via fillets so that there are no dead regions or catching regions for the liquid flow.

Figure 3:
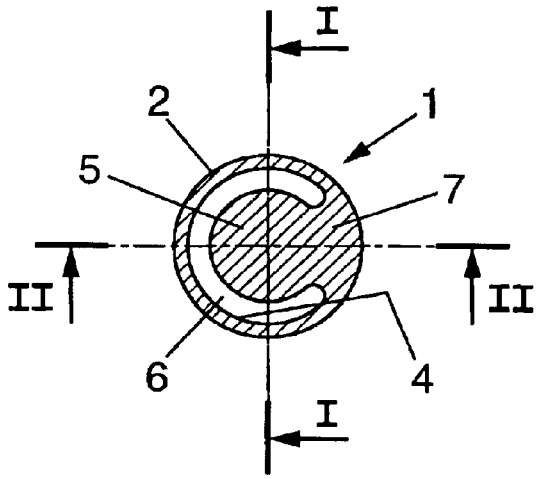
FIG. 3 is an end-on view, in section on III—III of FIG. 2, of the spout of FIGS. 1 and 2.

In a spout shaped as has just been described, the orifice 9 via which the passage 7 opens runs in an arc of a circle as illustrated in FIG. 3. In the exemplary embodiment illustrated, the angular extent of the orifice 9 is about 270°, while the angular extent of the leg 7 is of the order of 90°.

Figure 6:
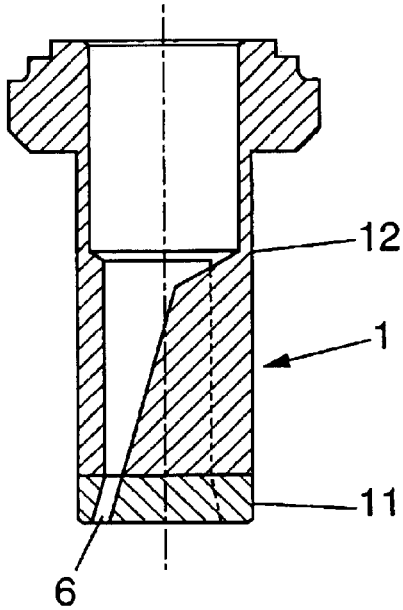
FIG. 6 is a view, in diametral section similar to that of FIG. 2, of an alternative form of embodiment of the spout of FIG. 2.
Figure 7:
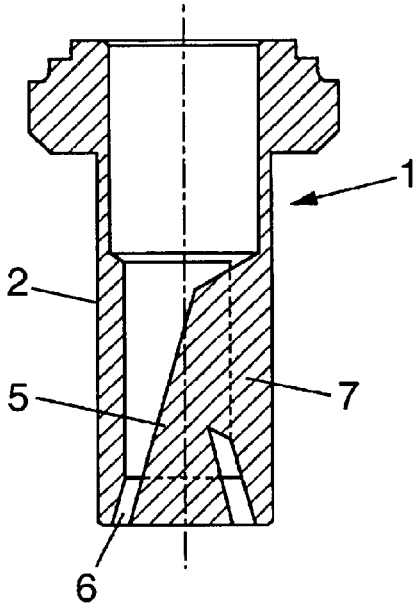
FIG. 7 is a view in diametral section similar to that of FIG. 2, of yet another alternative form of embodiment of the spout of FIGS. 1 to 5.

The spout that has just been described with reference to FIGS. 1 to 5 may prove difficult to manufacture in one piece because of the machining operations that are tricky to perform (the part being made of metal, for example steel) in view of its complex internal shapes. It may therefore be beneficial to manufacture it in two parts: one part 11 consists of a lower portion (incorporating part of the body 1, part of the conical core 5 and part of the leg 7) corresponding, axially, to the divergent conical passage 6; the other part 12 consists of the remaining portion of the body 1, that is to say the portion situated above the divergent conical passage 6. The two parts 11 and 12 are then joined end to end and secured, for example by welding. This embodiment is illustrated in FIG. 6.

The filling spout described hereinabove and depicted in FIGS. 1 to 7 comprises a liquid-jet orifice 6 with an outline in the shape of an arc of a circle (extending over about 270° in the examples illustrated). This results, since this orifice does not run over a complete turn (360°), in a reduction in the liquid flow rate and therefore in a lower container filling speed.

Figure 9:
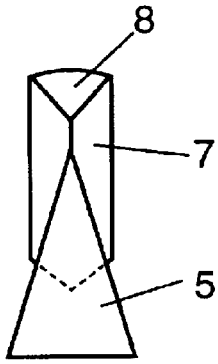
FIG. 9 is a schematic side view of part of the internal arrangement of the spout of FIG. 7.
Figure 8:
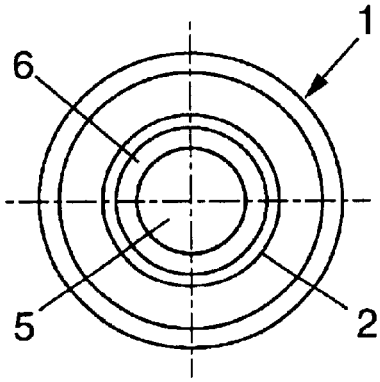
FIG. 8 is an end-on view from beneath of the spout of FIG. 7.

It is possible, by suitably configuring the leg 7, to produce an entirely circular orifice 6 with, however, counterbalancing this, a smaller cross section for connection between the leg 7 and the central core 5 and a smaller overhang of the latter. To achieve this, the leg 7 does not run as far as the lower end of the conical core 5, but is interrupted upstream of this lower end, or even preferably is interrupted upstream of the start of the divergent frustoconical passage 6 as illustrated in FIG. 9 which shows, by themselves, viewed from above, the conical core 5 and, under it, the leg 7. By giving the leg 7 a profiled lower end it is possible to make the liquid streams flowing on either side of said leg 7 join up again downstream, forming an entirely circular curtain of liquid flowing through the orifice 6, itself also entirely circular (see FIGS. 7 and 8).

What is claimed is:

1. A filling spout for distributing a liquid to a container, of the type in which the spout has a liquid-distribution passage of at least quasi-annular cross section which generates an umbrella-shaped liquid jet at the outlet orifice, said passage being defined by two roughly parallel and roughly frustoconical facing walls, one of them, the outer one, belonging to a spout body and the other, the inner one, belonging to a central core of conical shape widening toward the aforesaid orifice and supported, by support means inserted between said core and the spout body roughly coaxially in a roughly cylindrical duct defined in the spout body and ending at the aforesaid outer frustoconical wall, wherein said support means comprise a leg which is inserted between said conical core and at least the wall of the cylindrical duct and which runs at least from the tip of the conical central core toward the orifice, wherein the leg is in the shape of a dihedron resting on the wall of the duct and comprising a knife edge coinciding with the axis of the conical central core, and wherein the upstream transverse wall of the leg, which is approximately triangular in shape, is inclined, upward, from the upstream to downstream direction.

2. The filling spout as claimed in claim 1, wherein the leg runs as far as the lower end of the conical core and in that the distribution orifice is in the shape of a bean.

3. The filling spout as claimed in claim 1, wherein the leg does not run as far as the lower end of the conical core and in that the distribution orifice is shaped as a full annulus.

4. The filling spout as claimed in claim 1, wherein the leg starts upstream of the tip of the conical core and in that the knife edge of the dihedron formed by the leg, between its origin and the tip of the conical core, is inclined and situated roughly in the continuation of the upper generatrix of the conical core.

5. The filling spout as claimed in claim 1, wherein the central core is roughly conical of revolution, wherein the canal is roughly cylindrical of revolution, and wherein the distribution orifice forms a bean shape running roughly in an arc of a circle.

6. The filling spout as claimed in claim 1, wherein the leg is connected to the conical central core and to the wall of the cylindrical duct by respective rounded fillets.

* * * * *